US008117793B2

(12) United States Patent
Jankovec et al.

(10) Patent No.: US 8,117,793 B2
(45) Date of Patent: Feb. 21, 2012

(54) SUSPENDED CEILING GRID ASSEMBLY WITH SEPARATION JOINTS

(75) Inventors: Scott G. Jankovec, Elmhurst, IL (US); Peter G. Jahn, Palos Park, IL (US)

(73) Assignee: Chicago Metallic Corporation, Chicago, IL (US)

( * ) Notice: Subject to any disclaimer, the term of this patent is extended or adjusted under 35 U.S.C. 154(b) by 413 days.

(21) Appl. No.: 12/340,907

(22) Filed: Dec. 22, 2008

(65) Prior Publication Data

US 2009/0165417 A1 Jul. 2, 2009

Related U.S. Application Data

(60) Provisional application No. 61/017,437, filed on Dec. 28, 2007, provisional application No. 61/078,492, filed on Jul. 7, 2008, provisional application No. 61/108,904, filed on Oct. 28, 2008.

(51) Int. Cl.
*E04B 2/00* (2006.01)

(52) U.S. Cl. ..... 52/506.07; 52/506.08; 52/664; 52/506.06

(58) Field of Classification Search ..... 52/506.01, 52/506.1, 506.06, 506.07, 506.08, 506.09, 52/664, 665
See application file for complete search history.

(56) References Cited

U.S. PATENT DOCUMENTS

| | | | | |
|---|---|---|---|---|
| 3,089,579 | A | 5/1963 | O'Neil, Jr. | |
| 3,292,332 | A | 12/1966 | Jahn | |
| 3,492,888 | A | 2/1970 | Nishimura et al. | |
| 4,106,878 | A | 8/1978 | Jones | |
| 4,479,341 | A | 10/1984 | Schuplin | |
| 4,494,350 | A * | 1/1985 | Sharp | 52/665 |
| 4,785,595 | A | 11/1988 | Dunn | |
| 5,517,796 | A * | 5/1996 | Koski et al. | 52/506.07 |
| 5,839,246 | A * | 11/1998 | Ziegler et al. | 52/506.07 |
| 5,893,249 | A * | 4/1999 | Peterson et al. | 52/506.07 |
| 5,941,029 | A | 8/1999 | MacLeod | |
| 5,966,887 | A * | 10/1999 | Mieyal | 52/506.07 |
| 6,851,238 | B2 * | 2/2005 | Rebman | 52/506.07 |
| 7,293,393 | B2 | 11/2007 | Kelly et al. | |
| 7,661,236 | B2 * | 2/2010 | Platt et al. | 52/506.06 |
| 7,788,872 | B2 * | 9/2010 | Platt | 52/665 |
| 2004/0068953 | A1 | 4/2004 | Sauer | |
| 2006/0096219 | A1 | 5/2006 | Ingratta et al. | |
| 2007/0180787 | A1 | 8/2007 | Fecska | |
| 2008/0060306 | A1 | 3/2008 | Platt et al. | |
| 2009/0223146 | A1 | 9/2009 | Platt | |

OTHER PUBLICATIONS

PCT Written Opinion of the International Searching Authority dated 10.2.209 for PCT/US 08/88007 Filed Dec. 22, 2008.
Armstrong World Industries, Inc., Armstrong Seismic Joint Clip Product Description, © 2007.
Chicago Metallic Corporation, Technical Data Sheet TD-C-17 for Thermal Expansion Joints in Suspended Ceilings, © 1998.

* cited by examiner

*Primary Examiner* — Basil Katcheves
*Assistant Examiner* — Beth Stephan
(74) *Attorney, Agent, or Firm* — Cook Alex Ltd.

(57) ABSTRACT

A seismic separation joint is provided for connecting end-to-end a first grid tee to a second grid tee. Each grid tee includes a central web, with a tongue or tab extending from the web. Preferably, an elongated slot extends from the web into the tongue/tab associated therewith, with the slots being aligned when the first grid tee is connected to the second grid tee. A fastener is received in a portion of the tongue/tab of at least one, and preferably both, of the grid tees distally of the slot in one grid tee and in the slot of the other grid tee.

18 Claims, 3 Drawing Sheets

SUSPENDED CEILING GRID ASSEMBLY WITH SEPARATION JOINTS

CROSS REFERENCE TO RELATED APPLCATIONS

This application claims the benefit of the filing dates of U.S. Provisional Applications 61/017,437, filed Dec. 28, 2007, 61/078,492, filed Jul. 7, 2008, and 61/108,904, filed Oct. 28, 2008, the entire contents of each being incorporated by reference herein.

BACKGROUND OF THE INVENTION

Suspended ceiling systems are well-known in which a plurality of main runners extend parallel to each other, with cross members extending between the main runner at spaced intervals for supporting ceiling tiles or panels. The main runners and cross members, or cross tees, generally have an inverted T cross-sectional configuration, with a pair of oppositely-extending flanges connected by a web portion to a reinforcing bulb or bead. The cross members are typically connected to the main runners by a tongue that extends from the ends of the cross members and are received in an elongated slot in the web of the main runner.

It is also known to provide for a "fire rated" suspended ceiling system in which the connection between the main runners and the associated cross tees allows for limited expansion of the cross tees caused by an elevated temperature that would result from a fire without buckling the main runners. See, e.g., U.S. Pat. Nos. 4,601,153 and 4,677,802, both of which are incorporated herein by reference.

More recently, ceiling grid systems have been developed that allow for lateral movement of the cross members both into and away from the main runners, while maintaining the assembled relationship of the grid system, for use in geographical regions subject to earthquakes. Standards and requirements have been promulgated for ceiling suspension systems and areas requiring seismic restraint. Specifically, the International Building Code ("IBC") requires the provision of a seismic separation joint for all ceiling areas exceeding 2,500 square feet. One method for providing for the separation joint is disclosed in U.S. Published Application US 2007/0180787, where joint clips are provided which attach to the grid at the points of intersection of the main runners and the cross-members. The clips support the reinforcing bulbs of the grid member so that the cross tees continue to be supported by the main runners upon separation. Consequently, an over-wide flange on the main runners is not required for support of the cross members.

By way of the present disclosure, an improved separation joint is provided. Specifically, the present disclosure provides for a seismic separation joint that does not require an additional clip member.

SUMMARY OF THE DISCLOSURE

A seismic separation joint for suspended ceiling grid system is provided in which the grid system comprises at least one main runner or tee and a pair of opposed cross tees that are secured to the main runner and extend in opposite directions therefrom. The tees each include a central web with a tongue or tab extending from the web. In the case of the cross tees, the tongues are slidably received in a slot in the web of the main runner. An elongated slot is formed in the web of the tees of a length corresponding to the amount of movement to be allowed for in the event of a seismic occurrence. Preferably, the elongated slot extends from the web of the tee into the tongue/tab associated therewith, such that the slots of the tees are aligned when a pair of tees are connected to each other. A fastener is received in a portion of the tongue/tab of at least one, and preferably both, of the tees distally of the slot and in the slot of the other tee, securing the tees to the to each other while providing for limited movement of the tees both into and away from each other.

BRIEF DESCRIPTION OF THE DRAWINGS AND PHOTOGRAPHS

DETAILED DESCRIPTION

Figure 1:
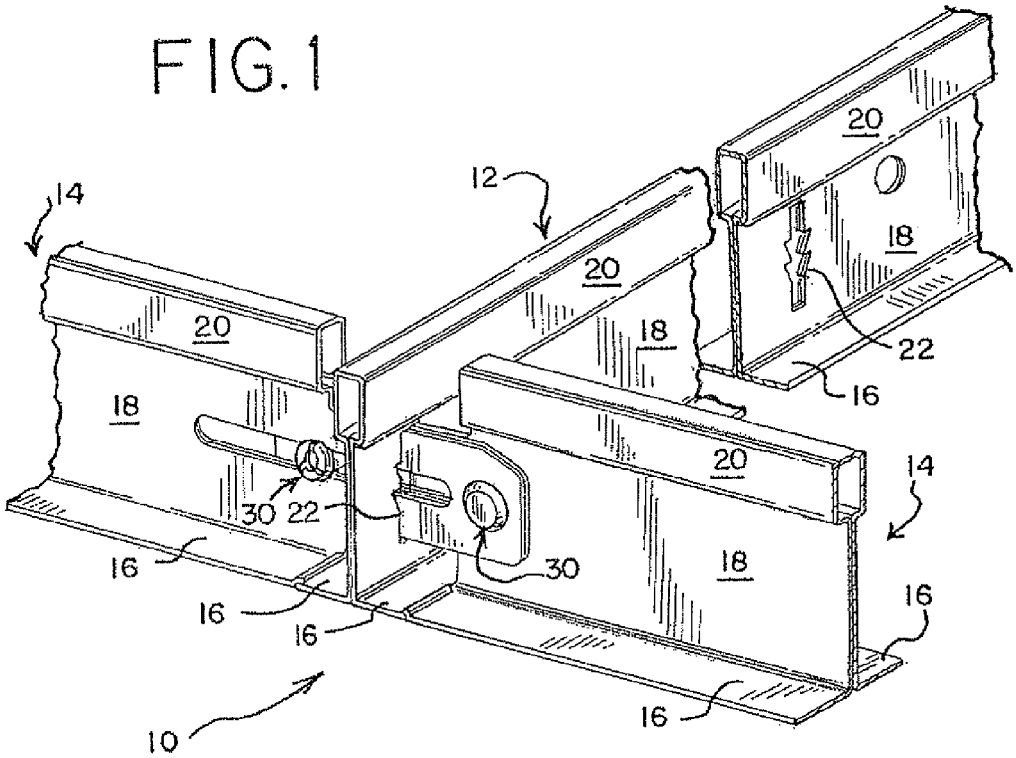
FIG. 1 is a perspective view of a portion of a suspended ceiling grid system with at least one main runner and a plurality of cross tees secured thereto in accordance with the present disclosure.
Figure 2:
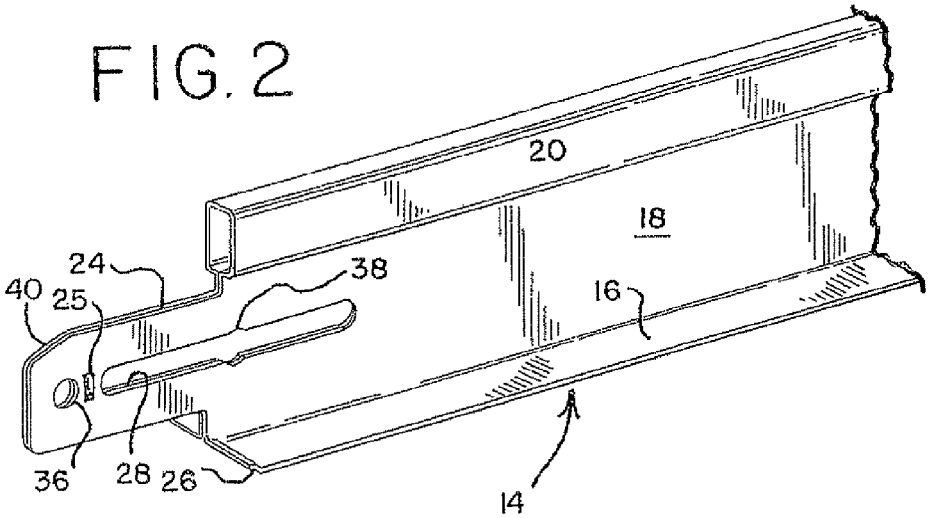
FIG. 2 is a fragmentary perspective view of the end of a cross tee according to the present disclosure.

A description follows of specific embodiments shown in the accompanying drawings. However, this is for the purposes of illustration of the principles of the invention only, and not by way of limitation.

Turning to the drawings, there is seen a grid system for a suspended ceiling generally designated 10 comprising one or more main runners 12 generally extending the span of the grid system 10 and a plurality of cross members or cross tees 14 typically spanning between adjacent main runners 12.

Both the main runners 12 and the cross tees 14 (both of which may be generally referred to as "tees") have a similar, inverted T-shaped cross-sectional configuration, as is well known in the art and exemplified by the U.S. patents incorporated by reference above. Specifically, the runners 12 and cross tees 14 are formed of strips of sheet metal with a pair of opposed flanges 16, 16 defining the lower surface. The flanges are connected by a central web 18 to a reinforcing bulb or bead 20. As is well known in the art, the flanges 16, 16 may be covered along their length on their bottom surfaces with an additional strip that is bent over the edges of the flanges.

The web 18 of the main runner 12 includes a plurality of vertically-oriented elongated openings or slots 22 at spaced intervals corresponding to the connection points for the cross tees 14 to the main runners. In order to connect the cross tees 14 to the main runners 12, the webs 18 of the cross tees 14 are formed with tongues 24 that extend beyond the end surfaces of the bead and the flanges 16 and are adapted to be received in the slots 22 in the main runners 12. The tongues 24 and the portions of the web 18 adjacent thereto may be embossed to provide additional strength and stiffness. Preferably, the tongue 24 is provided with an embossment or stitch 25 between the end of the slot 22 and the tip of the tongue 24 to enhance the rigidity of the tongue 24 and to prevent separation of the web. The end surfaces of the flanges 16, 16 of the cross tees include an edge portion 26 which is offset from the plane defined by the flanges 16, 16 by amount approximately equal to the thickness of the flanges so that, when the cross tees are installed in the ceiling grid, the offset edges 26 are positioned above the flanges 16, 16 of the main runners 12, and the flanges of the main runners 12 and the cross tees 14 are in the same plane.

In keeping with the disclosure, a separation joint is provided between the tees of the grid system that permits a predetermined amount of longitudinal movement of the tees without compromising the structural integrity of the grid system. Specifically, the main runners and cross tees are inter-connected to form the grid system so that they are capable of limited movement both into and away from each other in response to, e.g., a seismic event.

Figure 4:
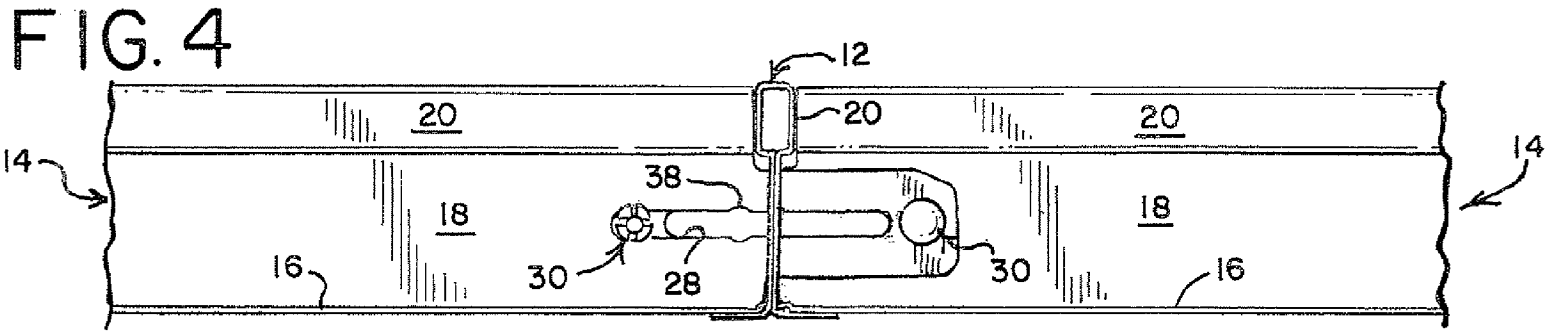
FIG. 4 is a side elevational view of an assembled separation joint according to the present disclosure in its maximum compressed position.
Figure 5:
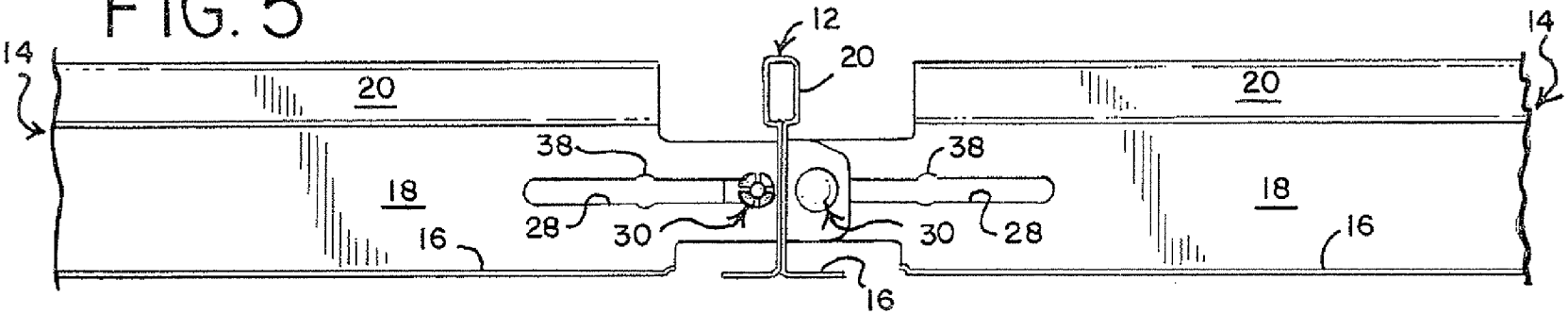
FIG. 5 is a side elevational view of an assembled separation joint according to the present disclosure in its maximum extended position.
Figure 6:
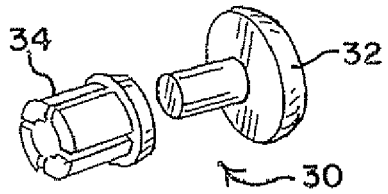
FIGS. 6 and 7 are exploded and assembled perspective views of a fastener assembly that may be advantageously used in combination the tees of the present disclosure.
Figure 7:
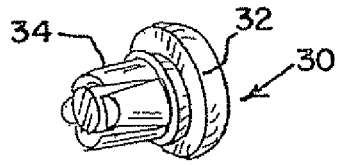

To this end, the cross tees are formed with a generally horizontal slot 28 that extends generally equidistant into both the tongues 24 and the web 18 of the cross tee. When the tongues 24 of a pair of cross tees 14 are inserted into a slot 22 in the web 18 of a main runner 12, the distal end of the tongue of each of the cross tees is slidably secured to the slot of the tongue of the other cross tee so that movement of the cross tees 14 relative to the main runner 12 along the length of the slot 28 both into the main runner (FIG. 4) and away from the main runner (FIG. 5) is accommodated without the cross tees 14 become disassociated from either each other or the main runner 12.

The tongues 24 of the cross tees 14 may be secured in the slot 28 of the mating cross tee by any fastener 30 that permits slidable movement along the length of the slot. In the illustrated embodiment, the fastener 30 comprises a rivet 32 that is received in a sleeve 34 that expands when the rivet is inserted therein. However, a screw or bolt may also be used. In the illustrated embodiment, the fastener 30 is received in an aperture 36 on the distal end of the tongue 24 that is in generally axial alignment with the slot 28. While two fasteners are used in the illustrated embodiments, a slip joint according to the present disclosure may also be assembled with a single fastener. The materials from which the fastener and runner are constructed may be advantageously selected so that a predetermined minimum force is required before either of the fastener or the slot/aperture that receives the fastener will fail.

In keeping with another aspect of the disclosure, the diameter of the shaft portion of the assembled fastener 30 may be slightly greater than the overall width of the slot, and the slot slightly oversized at a central portion of the slot (in general alignment with the ends of the bead and the flanges) to form a seat 38 that locates the fastener during the initial assembly and installation of the ceiling grid. Thus, to permit relative movement of the cross tees with respect to the main runner after initial installation, a force sufficient to slightly widen the slot 28 and/or deform the fastener 30 is required. The required deformation also provides a degree of internal friction in the sliding joint and a level of damping or energy dissipation during relative movement of the grid members.

Figure 3:
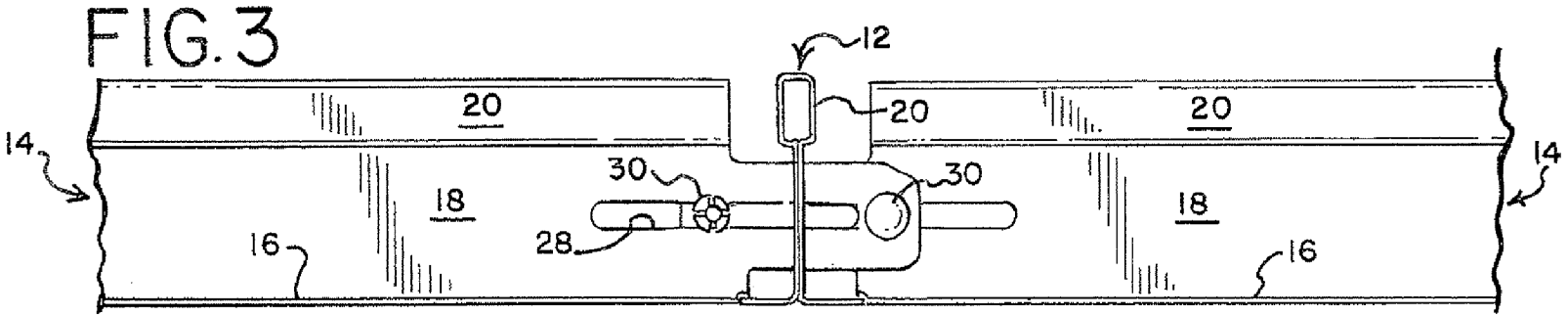
FIG. 3 is a side elevational view of the end of an assembled separation joint according to the present disclosure in its initial position.

Optionally, the reinforcing bead 20 of the cross tees 14 may be extended so that the beads 20 contact the reinforcing bead 20 of the main runner 12 when the grid 10 is in its initial, assembled condition (i.e., as shown in FIG. 3). This aids in assembly of the grid 10, as the seats 38 for the fasteners 30 are aligned with the apertures 36 in the tongues 24 when the reinforcing beads of the cross tees 14 contact the reinforcing bead of the main runner 12. The extended portion of the bead is preferably weakened to allow the extension to deform, collapse, or be displaced to the side when subjected to an axial compressive force. The extended portion of the bead may be weakened by flattening and/or providing cutouts or notches, although other techniques will be apparent to those skilled in the art.

Figure 8:
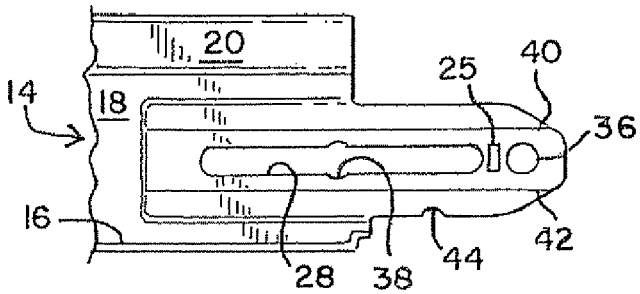
FIG. 8 is a fragmentary side view of an alternative embodiment of a cross tee in accordance with the present disclosure.

Also, the end of the tongue 24 may be narrowed in width to facilitate its insertion into the slots 22 in the main runner 12. This may be accomplished by having a bevel 40 on the end of the tongue. Optionally, the end of the tongue 24 may have a second bevel 42 (best seen in FIG. 8) for this same purpose. Also, with reference to FIG. 8, the tongue 24 may include a notch 44 in the bottom of the tongue 24 to facilitate centering the cross tee 14 relative to the main runner 12, the notch 44 seating on the bottom of the slot 22. The notch 44 is preferably trapezoidal in shape, but other shapes are also contemplated.

Figure 9:
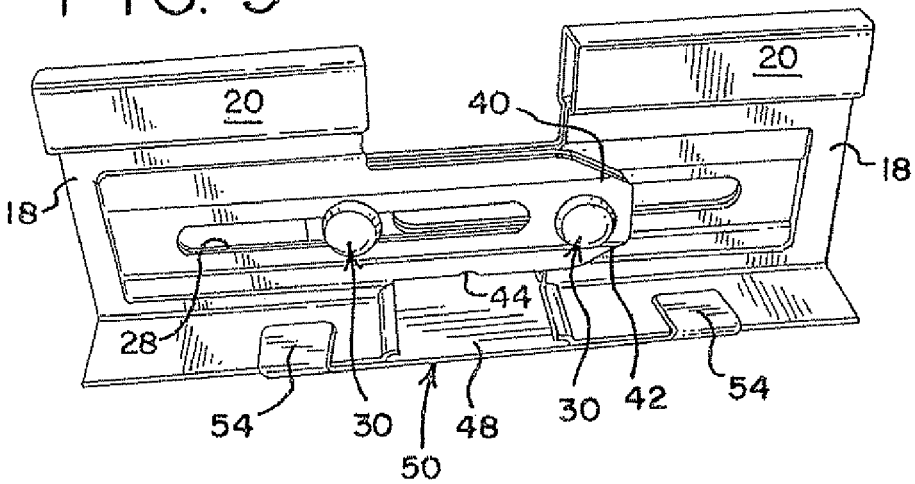
FIG. 9 is a perspective view of an assembled separation joint connection for connecting two main runners end-to-end.

Turning to FIG. 9, the separation joint according to the present application is shown in the context of connecting two main runners in an end-to-end manner. The details as to the tongues, slots and fasteners are generally the same as that described above. As a consequence, the reference numerals used in connection with the embodiments shown in FIGS. 1-8 are used for corresponding structure in the embodiment disclosed in FIG. 9.

Figure 10:
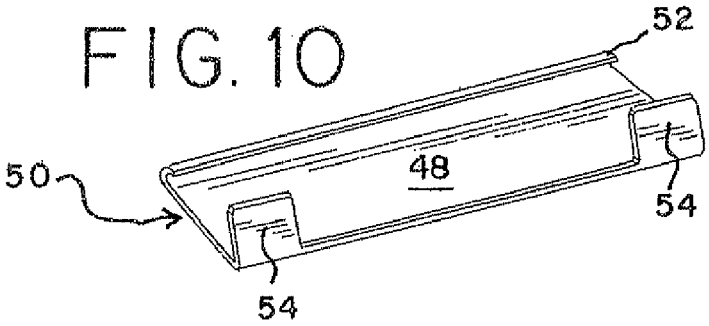
FIG. 10 is a perspective view of a cover that may be secured to the flanges of the runners.

When the separation joint of the present disclosure is used to connect two main runners end-to-end, a gap 46 between the ends of the flanges results. For aesthetic purposes, a cover 48 may be provided to close the gap 46. The cover 48 permits slidable movement of the runners with respect to the cover 48, as provided by the separation joint. With reference to FIG. 10, to facilitate installation, the outside edge 50 of the cover 48 is bent over so as to fit over a first edge of the flanges. The opposite, second edge 52 of the cover 48 includes at least one tab 54 (two such tabs being shown), such that when the first edge 50 of the cover 48 is located over the first edge of the flanges, the tab 54 may be bent back over the second edge of the flanges to secure the cover in place.

The invention claimed is:

1. A suspended ceiling grid system comprising at least first and second grid members extending end-to-end in opposite directions from each other, the first and second grid members each including reinforcing bulb and a central web, with a tab extending from the web, a separation joint for securing the first grid member to the second grid member and for providing limited movement of the first and second grid members toward and away from each other comprising:

an elongated slot in each grid member extending from the web of the grid member into the tab associated therewith, the slots of the grid members being aligned when the grid system is assembled, and a fastener having a shaft portion received in a portion of the tab of at least one of the grid members distally of the slot and in the slot of the tab of the other grid member, the elongated slot in each grid member including a seat for locating the fastener, the seat being sized to receive the shaft portion of the fastener and the slot being narrower than a diameter of the shaft portion of the fastener.

2. The suspended ceiling grid system of claim 1 wherein the seat for the fastener is located in an intermediate portion of the slot.

3. The suspended ceiling grid system of claim 1 wherein the reinforcing bulb of each grid member extends beyond the end of the grid member.

4. The suspended ceiling grid system of claim 3 in which the extended reinforcing bulb is weakened.

5. The suspended ceiling grid system of claim 1 wherein the ends of the tabs are narrowed in width.

6. The suspended ceiling grid system of claim 1 wherein the tabs have a centering notch.

7. the suspended ceiling grid system of claim 1 wherein the shaft of the fastener is oversized relative to the slot.

8. A suspended ceiling grid system comprising:

at least one main runner including a central web having at least one vertically-oriented elongated slot therein;

a pair of opposed cross tees secured to the main runner and extending in opposite directions therefrom, each cross tee including a reinforcing bulb and a central web, with a tab extending from its web that is slidably received in a slot in the web of the main runner, each cross tee further comprising:

an elongated slot in each cross tee extending from the web of the cross tee into the tab associated therewith, each tab having a notch thereon resting in the slot in the web of the main runner, the slots of the cross tees being aligned when the tabs are received in the main runner;

a fastener received in a portion of the tab of each cross tee distally of the slot and in the slot of the tongue of the other cross tee; and the slot in each cross tee including a seat for locating the fastener.

9. The suspended ceiling grid system of claim 8 wherein the seat in the slot is located in an intermediate portion of the slot.

10. The suspended ceiling grid system of claim 8 wherein the reinforcing bulb extends beyond the end of the cross tee.

11. The suspended ceiling grid system of claim 8 wherein the extended portion of the reinforcing bulb is weakened.

12. The suspended ceiling grid system of claim 8 wherein the end of the tab is narrowed in width.

13. The suspended ceiling grid system of claim 8 wherein the fastener is oversized relative to the slot.

14. An elongated tee having opposed ends for a suspended ceiling grid comprising opposed flanges, a strengthening bulb, a central web connecting the flanges to the strengthening bulb, and a tab extending from at least one end of the tee and having a free end, the tab having a longitudinally-extending elongated slot and an aperture adapted to receive a fastener located between the end of the slot and the end of the tab, wherein the slot includes a seat for locating a fastener, and the seat is located in an intermediate portion of the slot, the slot being narrower than a diameter of the seat.

15. The elongated tee of claim 14 wherein the reinforcing bulb extends beyond the end of the tee past the flanges.

16. The elongated tee of claim 15 wherein the extended portion of the reinforcing bulb is weakened.

17. The elongated fee member of claim 14 wherein the tab is narrowed in width.

18. The elongated tee member of claim 14 wherein the tab has a centering notch.

* * * * *